US009532139B1

(12) United States Patent
Lu et al.

(10) Patent No.: US 9,532,139 B1
(45) Date of Patent: Dec. 27, 2016

(54) DUAL-MICROPHONE FREQUENCY AMPLITUDE RESPONSE SELF-CALIBRATION

(71) Applicant: Cirrus Logic, Inc., Austin, TX (US)

(72) Inventors: Yang Lu, Austin, TX (US); Dayong Zhou, Austin, TX (US); Jon D. Hendrix, Wimberley, TX (US); Jeffrey Alderson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 503 days.

(21) Appl. No.: 13/721,832

(22) Filed: Dec. 20, 2012

Related U.S. Application Data

(60) Provisional application No. 61/701,187, filed on Sep. 14, 2012.

(51) Int. Cl.
*H04R 29/00* (2006.01)
*H04R 3/00* (2006.01)

(52) U.S. Cl.
CPC ..... *H04R 3/005* (2013.01)

(58) Field of Classification Search
CPC ..... H04R 3/00; H04R 3/002; H04R 3/005; H04R 3/04; H04R 29/00; H04R 29/004; H04R 1/08; H04R 1/04; H04R 1/406; H04R 1/1083; H04R 1/1091; H04R 2499/11; H04R 17/02; H04R 19/04; H04R 3/02; H04R 3/06; H04R 3/08; H04R 3/14; H04R 3/007; H04R 5/04; H04R 25/453; H04R 25/50; H04R 25/505; H04R 25/507; G06F 3/165; G06F 3/16; G06F 17/3074; G10K 11/175; G10K 11/002; G10K 11/16; G10K 11/178; G10K 2210/1282; G10K 2210/1081; G10K 2210/3016; G10K 2210/3037; G10K 2210/3056;H03G 5/16; H03G 5/165; H03G 3/00; H03G 3/348; H03G 1/00; H03G 1/0005; H03G 1/04; H03G 3/20; H03G 3/32; H03G 3/341; H03G 5/00; H03G 5/24; H03G 7/00; H03G 7/002; H03G 9/025; H03G 5/005; H03G 5/28; H03G 9/005; H03G 9/24; H03G 2201/702; H03G 7/007; G10L 21/0208; G10L 25/84; G10L 2021/02166
(Continued)

(56) References Cited

U.S. PATENT DOCUMENTS 4,020,567 A 5/1977 Webster
4,926,464 A 5/1990 Schley-May
(Continued)

FOREIGN PATENT DOCUMENTS

DE 102011013343 A1 9/2012
EP 0412902 2/1991
(Continued)

OTHER PUBLICATIONS

International Search Report and Written Opinion of the International Searching Authority, International Patent Application No. PCT/US2014/017343, mailed Aug. 8, 2014, 22 pages.
(Continued)

*Primary Examiner* — Leshui Zhang
(74) *Attorney, Agent, or Firm* — Robert P. Bell; Steven Lin

(57) ABSTRACT

A frequency domain method and system for online self-calibrating microphone frequency amplitude response based on noise floor (minima) tracking are disclosed. A cellular telephone or other system with dual microphones may self-calibrate itself on-the-fly. The system selects one of the microphones as a reference and calibrates the frequency response of the two microphones using the first microphone
(Continued)

as a reference, so that they have a matched frequency amplitude response. To achieve this on-the-fly calibration, the system uses background noise for calibration purposes. The signal power spectra of the noise minima at the two microphones is used to calibrate the respective microphone frequency response. The system may then adapt the frequency amplitude responses of the two microphones so that the power spectral density from each microphone matches the other, and the system is then calibrated. This calibration could occur any time the device is receiving a noise minima and could be done continuously as the device is being used.

13 Claims, 3 Drawing Sheets

(58) Field of Classification Search
USPC .... 381/1, 13, 56, 57, 58, 61, 317, 318, 320, 381/321, 71.1–71.14, 73.1, 83, 84, 91, 92, 381/93, 94.1, 94.2, 94.3, 94.5, 94.6, 94.7, 381/94.9, 95, 97–103, 120, 121, 122, 381/111–115; 700/94; 455/135, 226.3, 455/310; 379/22.08, 392.01, 379/406.01–406.16; 704/224–226, 704/E17.014, 203, 205
See application file for complete search history.

(56) References Cited

U.S. PATENT DOCUMENTS 4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell
5,548,681 A 8/1996 Gleaves et al.
5,550,925 A 8/1996 Hori et al.
5,559,893 A 9/1996 Krokstad et al.
5,586,190 A 12/1996 Trantow et al.
5,668,747 A 9/1997 Ohashi
5,687,075 A 11/1997 Strothers
5,696,831 A 12/1997 Inanaga et al.
5,740,256 A 4/1998 Castello Da Costa et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,991,418 A 11/1999 Kuo
6,041,126 A 3/2000 Terai et al.
6,181,801 B1 1/2001 Puthoff et al.
6,185,300 B1 2/2001 Romesburg
6,278,786 B1 8/2001 McIntosh
6,282,176 B1 * 8/2001 Hemkumar ..... 370/276
6,304,179 B1 10/2001 Lolito et al.
6,317,501 B1 11/2001 Matsuo
6,418,228 B1 7/2002 Terai et al.
6,445,799 B1 9/2002 Taenzer et al.
6,522,746 B1 2/2003 Marchok et al.
6,542,436 B1 4/2003 Myllya
6,650,701 B1 11/2003 Hsiang et al.
6,683,960 B1 1/2004 Fujii et al.
6,738,482 B1 5/2004 Jaber
6,766,292 B1 7/2004 Chandran
6,792,107 B2 9/2004 Tucker et al.
6,940,982 B1 9/2005 Watkins
7,016,504 B1 3/2006 Shennib
7,058,463 B1 6/2006 Ruha et al.
7,110,864 B2 9/2006 Restrepo et al.
7,181,030 B2 2/2007 Rasmussen et al.
7,365,669 B1 4/2008 Melanson
7,368,918 B2 5/2008 Henson et al.
7,441,173 B2 10/2008 Restrepo et al.
7,466,838 B1 12/2008 Moseley
7,680,456 B2 3/2010 Muhammad et al.
7,742,746 B2 6/2010 Xiang et al.
7,742,790 B2 6/2010 Konchitsky et al.
7,817,808 B2 10/2010 Konchitsky et al.
7,885,417 B2 2/2011 Christoph
7,953,231 B2 5/2011 Ishida
8,085,966 B2 12/2011 Amsel
8,107,637 B2 1/2012 Asada et al.
8,165,312 B2 4/2012 Clemow
8,165,313 B2 4/2012 Carreras
D666,169 S 8/2012 Tucker et al.
8,251,903 B2 8/2012 LeBouef et al.
8,325,934 B2 12/2012 Kuo
8,331,604 B2 12/2012 Saito et al.
8,374,358 B2 2/2013 Buck et al.
8,401,200 B2 3/2013 Tiscareno et al.
8,442,251 B2 5/2013 Jensen et al.
8,526,627 B2 9/2013 Asao et al.
8,559,661 B2 10/2013 Tanghe
8,600,085 B2 12/2013 Chen et al.
8,775,172 B2 7/2014 Konchitsky et al.
8,804,974 B1 8/2014 Melanson
8,831,239 B2 9/2014 Bakalos
8,842,848 B2 9/2014 Donaldson et al.
8,848,936 B2 9/2014 Kwatra et al.
8,855,330 B2 10/2014 Taenzer
8,907,829 B1 12/2014 Naderi
8,908,877 B2 12/2014 Abdollahzadeh Milani et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,066,176 B2 6/2015 Hendrix et al.
9,071,724 B2 6/2015 Do et al.
9,076,431 B2 7/2015 Kamath et al.
9,082,391 B2 7/2015 Yermeche et al.
9,094,744 B1 7/2015 Le et al.
9,106,989 B2 8/2015 Li et al.
9,107,010 B2 8/2015 Abdollahzadeh Milani et al.
9,129,586 B2 9/2015 Bajic et al.
9,230,532 B1 1/2016 Lu et al.
9,264,808 B2 2/2016 Zhou et al.
9,294,836 B2 3/2016 Zhou et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0196992 A1 10/2004 Ryan
2004/0202333 A1 * 10/2004 Csermak et al. ..... 381/60
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.

(56) References Cited

U.S. PATENT DOCUMENTS

2006/0109941 A1 5/2006 Keele, Jr.
2006/0159282 A1 7/2006 Borsch
2006/0161428 A1 7/2006 Fouret
2006/0251266 A1 11/2006 Saunders et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0076896 A1 4/2007 Hosaka et al.
2007/0208520 A1 9/2007 Zhang et al.
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2008/0269926 A1 10/2008 Xiang et al.
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1* 5/2009 Taenzer ..... H04R 3/005 381/74
2009/0175461 A1 7/2009 Nakamura et al.
2009/0175466 A1* 7/2009 Elko et al. ..... 381/94.2
2009/0238369 A1 9/2009 Ramakrishnan et al.
2009/0245529 A1 10/2009 Asada et al.
2009/0254340 A1 10/2009 Sun et al.
2009/0311979 A1 12/2009 Husted et al.
2010/0002891 A1 1/2010 Shiraishi et al.
2010/0014683 A1 1/2010 Maeda et al.
2010/0014685 A1 1/2010 Wurm
2010/0061564 A1 3/2010 Clemow et al.
2010/0082339 A1 4/2010 Konchitsky et al.
2010/0098263 A1 4/2010 Pan et al.
2010/0098265 A1 4/2010 Pan et al.
2010/0124335 A1 5/2010 Wessling et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0195844 A1 8/2010 Christoph et al.
2010/0226210 A1 9/2010 Kordis et al.
2010/0239126 A1 9/2010 Grafenberg et al.
2010/0246855 A1 9/2010 Chen
2010/0260345 A1 10/2010 Shridhar et al.
2010/0266137 A1 10/2010 Sibbald et al.
2010/0272276 A1 10/2010 Carreras et al.
2010/0272284 A1 10/2010 Joho et al.
2010/0274564 A1 10/2010 Bakalos et al.
2010/0284546 A1 11/2010 De Brunner et al.
2010/0291891 A1 11/2010 Ridgers et al.
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0026724 A1 2/2011 Doclo
2011/0091047 A1 4/2011 Konchitsky et al.
2011/0096933 A1 4/2011 Eastly
2011/0099010 A1 4/2011 Zhang
2011/0106533 A1 5/2011 Yu
2011/0116654 A1 5/2011 Chan et al.
2011/0129098 A1 6/2011 Delano et al.
2011/0130176 A1 6/2011 Magrath et al.
2011/0158419 A1 6/2011 Theverapperuma et al.
2011/0206214 A1 8/2011 Christoph et al.
2011/0222701 A1 9/2011 Donaldson et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1* 7/2012 Oh ..... G10L 21/0208 704/203
2012/0185524 A1 7/2012 Clark
2012/0207317 A1 8/2012 Abdollahzadeh Milani
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300955 A1 11/2012 Iseki et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0195282 A1 8/2013 Ohita et al.
2013/0243198 A1 9/2013 Van Rumpt
2013/0243225 A1 9/2013 Yokota
2013/0259251 A1 10/2013 Bakalos
2013/0315403 A1 11/2013 Samuelsson
2013/0343571 A1 12/2013 Rayala et al.
2014/0016803 A1 1/2014 Puskarich
2014/0036127 A1 2/2014 Pong et al.
2014/0044275 A1 2/2014 Goldstein et al.
2014/0050332 A1 2/2014 Nielsen et al.
2014/0072134 A1 3/2014 Po et al.
2014/0086425 A1 3/2014 Jensen et al.
2014/0126735 A1 5/2014 Gauger, Jr.
2014/0146976 A1 5/2014 Rundle
2014/0169579 A1 6/2014 Azmi
2014/0177851 A1 6/2014 Kitazawa et al.
2014/0177890 A1 6/2014 Hojland et al.
2014/0211953 A1 7/2014 Alderson et al.
2014/0270222 A1 9/2014 Hendrix et al.
2014/0270224 A1 9/2014 Zhou et al.
2014/0294182 A1 10/2014 Axelsson et al.
2014/0307887 A1 10/2014 Alderson
2014/0307888 A1 10/2014 Alderson et al.
2014/0307890 A1 10/2014 Zhou et al.
2014/0314244 A1 10/2014 Yong
2014/0314246 A1 10/2014 Hellman
2014/0314247 A1 10/2014 Zhang
2014/0341388 A1 11/2014 Goldstein
2014/0369517 A1 12/2014 Zhou et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0189434 A1 7/2015 Hendrix et al.
2015/0256660 A1 9/2015 Kaller et al.
2015/0256953 A1 9/2015 Kwatra et al.
2015/0269926 A1 9/2015 Alderson et al.
2015/0296296 A1 10/2015 Lu et al.
2015/0365761 A1 12/2015 Alderson et al.

FOREIGN PATENT DOCUMENTS

EP 0756407 1/1997
EP 0898266 2/1999
EP 1691577 11/2005
EP 1880699 A2 1/2008
EP 1947642 A1 7/2008

(56) References Cited

FOREIGN PATENT DOCUMENTS

| | | | | |
|---|---|---|---|---|
| EP | 2133866 | A1 | 12/2009 | |
| EP | 2237573 | | 10/2010 | |
| EP | 2216774 | A1 | 8/2011 | |
| EP | 2395500 | A1 | 12/2011 | |
| EP | 2395501 | A1 | 12/2011 | |
| EP | 2551845 | | 1/2013 | |
| GB | 2346657 | | 10/2007 | |
| GB | 2455824 | A1 | 6/2009 | |
| GB | 2455828 | A1 | 6/2009 | |
| GB | 2484722 | A | 4/2012 | |
| GB | 1512832.5 | | 1/2016 | |
| GB | 1519000.2 | | 4/2016 | |
| JP | 06006246 | | 1/1994 | |
| JP | H06232755 | | 8/1994 | |
| JP | 07098592 | | 4/1995 | |
| JP | 07104769 | | 4/1995 | |
| JP | 07240989 | | 9/1995 | |
| JP | 07325588 | | 12/1995 | |
| JP | H11305783 | | 11/1999 | |
| JP | 2000089770 | | 3/2000 | |
| JP | 2002010355 | | 1/2002 | |
| JP | 2004007107 | | 1/2004 | |
| JP | 2006217542 | | 8/2006 | |
| JP | 2007060644 | | 3/2007 | |
| JP | 2008015046 | | 1/2008 | |
| JP | 2010277025 | | 12/2010 | |
| JP | 2011061449 | | 3/2011 | |
| WO | 9113429 | | 9/1991 | |
| WO | 9911045 | | 3/1999 | |
| WO | 03015074 | A2 | 2/2003 | |
| WO | WO03015275 | A1 | 2/2003 | |
| WO | WO2004009007 | A1 | 1/2004 | |
| WO | WO2004017303 | A1 | 2/2004 | |
| WO | 2006125061 | | 11/2006 | |
| WO | 2006128768 | | 12/2006 | |
| WO | 2007007916 | A1 | 1/2007 | |
| WO | 2007011337 | | 1/2007 | |
| WO | 2007110807 | | 10/2007 | |
| WO | 2007113487 | A1 | 11/2007 | |
| WO | 2009041012 | | 4/2009 | |
| WO | 2009110087 | | 9/2009 | |
| WO | 2010117714 | A1 | 10/2010 | |
| WO | 2010131154 | | 11/2010 | |
| WO | WO 2012107561 | A1 * | 8/2012 | ..... H04R 3/005 |
| WO | 2012134874 | A1 | 10/2012 | |
| WO | 2013106370 | | 7/2013 | |
| WO | 2014172005 | | 10/2014 | |
| WO | 2014172021 | | 10/2014 | |
| WO | 2015038255 | | 3/2015 | |
| WO | 2015088639 | | 6/2015 | |
| WO | 2015088651 | | 6/2015 | |
| WO | 2015088653 | | 6/2015 | |
| WO | 2015134225 | | 9/2015 | |
| WO | 2015191691 | | 12/2015 | |
| WO | PCTUS2015066260 | | 4/2016 | |

OTHER PUBLICATIONS

International Search Report and Written Opinion of the International Searching Authority, International Patent Application No. PCT/US2014/018027, mailed Sep. 4, 2014, 14 pages.

International Search Report and Written Opinion of the International Searching Authority, International Patent Application No. PCT/US2014/017374, mailed Sep. 8, 2014, 13 pages.

International Search Report and Written Opinion of the International Searching Authority, International Patent Application No. PCT/US2014/019395, mailed Sep. 9, 2014, 14 pages.

International Search Report and Written Opinion of the International Searching Authority, International Patent Application No. PCT/US2014/019469, mailed Sep. 12, 2014, 13 pages.

Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.

Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.

Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.

Widrow, B. et al., Adaptive Noise Cancelling; Principles and Applications, Proceedings of the IEEE, IEEE, New York, NY, U.S. vol. 63, No. 13, Dec. 1975, pp. 1692-1716.

Morgan, Dennis R. et al., A Delayless Subband Adaptive Filter Architecture, IEEE Transactions on Signal Processing, IEEE Service Center, New York, New York. US, vol. 43, No. 8, Aug. 1995, pp. 1819-1829.

International Search Report and Written Opinion of the International Searching Authority, International Patent Application No. PCT/US2014/040999, mailed Oct. 18, 2014, 12 pages.

International Search Report and Written Opinion of the International Searching Authority, International Patent Application No. PCT/US2034/049407, mailed Jun. 18, 2914, 13 pages.

James G. Ryan, Rafik A. Goubran, "Optimum near-field performance of microphone arrays subject to a far-field beampattern constraint", 2248 J. Acoust. Soc. Am. 108, Nov. 2000.

I. Cohen, B. Berdugo, "Noise Estimation by Minima Controlled Recursive Averaging for Robust Speech Enhancement", IEEE Signal Processing Letters, vol. 9, No. 1, Jan. 2002.

R. Martin, "Noise Power Spectral Density Estimation Based on Optimal Smoothing and Minimum Statistics", IEEE Trans. on Speech and Audio Processing, col. 9, No. 5, Jul. 2001.

R. Martin, "Spectral Subtraction Based on Minimum Statistics", Proc. 7th EUSIPCO '94, Edinburgh, U.K., Sep. 13-16, 1994, pp. 1182-1195.

I. Cohen, "Noise Spectrum Estimation in Adverse Environments: Improved Minima Controlled Recursive Averaging", IEEE Trans. on Speech & Audio Proc., vol. 11, Issue 5, Sep. 2003.

A.A. Miliani, G. Kannan, and I.M.S. Panahi, "On maximum achievable noise reduction in ANC systems", in Proc. ICASSP, 2010, pp. 349-352, Mar. 2010.

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (INDICON) 2011 Annual IEEE, IEEE, Dec. 15, 2011.

Rangachari et al., "A noise-estimation algorithm for highly non-stationary environments" Speech Communication, Elsevier Science Publishers, vol. 48, No. 2, Feb. 1, 2006.

Jin, et al. "A simultaneous equation method-based online secondary path modeling algorithm for active noise control", Journal of Sound and Vibration, Apr. 25, 2007, pp. 455-474, vol. 303, No. 3-5, London, GB.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

(56) References Cited

OTHER PUBLICATIONS

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Pfann, et al., "LMS Adaptive Filtering with Delta-Sigma Modulated Input Signals", IEEE Signal Processing Letters, vol. 5, No. 4, Apr. 1998.
Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Parkins, et al., "Narrowband and broadband active control in an enclosure using the acoustic energy density", J. Acoust. Soc. Am. Jul. 2000, pp. 192-203, vol. 108, issue 1, US.
Rafaely, Boaz, "Active Noise Reducing Headset—an Overview", The 2001 International Congress and Exhibition on Noise Control Engineering, Aug. 27-30, 2001, 10 pages (pp. 1-10 in pdf), The Netherlands.
Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, , vol. 120, No. 4, New York, NY.

* cited by examiner

DUAL-MICROPHONE FREQUENCY AMPLITUDE RESPONSE SELF-CALIBRATION

CROSS-REFERENCE TO RELATED APPLICATIONS

The present application claims priority from Provisional U.S. Patent Application No. 61/701,187 filed on Sep. 14, 2012, and incorporated herein by reference.

FIELD OF THE INVENTION

The present invention relates to a self-calibration system for use with two or more microphones. In particular, the present invention is directed toward a self-calibration system for use in a cellular telephone or the like, where dual microphones may be used for a noise cancellation circuit or other ambient event detector processes. Other applications may include a microphone array circuit, and noise suppression circuit, or other applications where multiple microphones may be utilized and calibration between microphones may be required.

BACKGROUND OF THE INVENTION

A personal audio device, such as a wireless telephone, may include a noise canceling circuit to reduce background noise in audio signals. One example of such a noise cancellation circuit is an adaptive noise cancellation circuit that adaptively generates an anti-noise signal from a reference microphone signal and injects the anti-noise signal into the speaker or other transducer output to cause cancellation of ambient audio sounds. An error microphone may also be provided proximate the speaker to measure the ambient sounds and transducer output near the transducer, thus providing an indication of the effectiveness of the noise canceling. A processing circuit uses the reference and/or error microphone, optionally along with a microphone provided for capturing near-end speech, to determine whether the noise cancellation circuit is incorrectly adapting or may incorrectly adapt to the instant acoustic environment and/or whether the anti-noise signal may be incorrect and/or disruptive and then take action in the processing circuit to prevent or remedy such conditions.

Examples of such adaptive noise cancellation systems are disclosed in published U.S. Patent Application 2012/0140943, published on Jun. 7, 2012, and Published U.S. Patent Application 2012/0207317, published on Aug. 16, 2012, both of which are incorporated herein by reference. Both of these references are assigned to the same assignee as the present application, and one names at least one inventor in common and thus are not "Prior Art" to the present application. However, they are provided to facilitate the understating of noise cancellation circuits as applied in the field of use. These references are provided by way of background only to illustrate one problem solved by the present invention. They should not be taken as limiting the present invention to any one type of multi-microphone application or noise cancellation circuit.

Referring now to FIG. 1, a wireless telephone 10 is shown in proximity to a human ear 5. Wireless telephone 10 includes a transducer, such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes active noise canceling circuits and features that inject an anti-noise signal into speaker SPKR to improve intelligibility of the distant speech and other audio reproduced by speaker SPKR. A reference microphone R is provided for measuring the ambient acoustic environment and is positioned away from the typical position of a user's mouth, so that the near-end speech is minimized in the signal produced by reference microphone R. Prior art noise cancellation circuits rely on the use of two microphones (E and R). The embodiment of FIG. 1 also provides a third microphone, near-speech microphone NS, in order to further improve the noise cancellation operation by monitoring the ambient disturbance to the noise cancellation system when wireless telephone 10 is in close proximity to ear 5. Exemplary circuit 14 within wireless telephone 10 includes an audio CODEC integrated circuit 20 that receives the signals from reference microphone R, near speech microphone NS and error microphone E and interfaces with other integrated circuits such as an RF integrated circuit 12 containing the wireless telephone transceiver.

In general, the noise cancellation techniques measure ambient acoustic events (as opposed to the output of speaker SPKR and/or the near-end speech) impinging on reference microphone R, and by also measuring the same ambient acoustic events impinging on error microphone E, the noise cancellation processing circuits of illustrated wireless telephone 10 adapt an anti-noise signal generated from the output of reference microphone R to have a characteristic that minimizes the amplitude of the ambient acoustic events at error microphone E. Since acoustic path P(z) (also referred to as the passive forward path) extends from reference microphone R to error microphone E, the noise cancellation circuits are essentially estimating acoustic path P(z) combined with removing effects of an electro-acoustic path S(z) (also referred to as secondary path) that represents the response of the audio output circuits of CODEC IC 20 and the acoustic/electric transfer function of speaker SPKR including the coupling between speaker SPKR and error microphone E in the particular acoustic environment, which is affected by the proximity and structure of ear 5 and other physical objects and human head structures that may be in proximity to wireless telephone 10, when wireless telephone is not firmly pressed to ear 5.

The dual microphone (R and NS) system of FIG. 1 is widely used in mobile telephony for uplink noise suppression. In order to protect the noise cancellation system, oversight software requires audio signals from R and NS microphones in order to detect certain situations, such as close talk, wind noise, howling, and the like. Close talk, as the term is known, occurs when the near-end user is talking while holding the phone to his/her ear. Wind noise occurs when wind buffets the microphone, producing loud buffeting noises. Howling occurs when an anti-noise signal is picked up by microphone R, and it is played out speaker SPKR. The speaker output gets coupled back to the reference microphone R and sets up a positive feedback loop. Howling can occur, for example, if a user cups their hand from the speaker back to the reference microphone R, or if there is some internal leakage path. Scratching is a term used to describe physical contact with a microphone, which produces a loud scratching noise.

Gain mismatch between the two microphones can reduce robustness and increase failures in detecting situations, such as close talk, scratch, howling and the like. If the gain from the two microphones differs, then the signal levels from the microphones will be different from one another, even when transmitting the same sound levels. In actual practice, some gain mismatch between the microphones is inevitable, due to manufacturing tolerances, microphone mounting and placement and the like. The absolute difference of amplitude frequency response could vary in a range of 0 to 10 dB or more.

Factory calibration of the microphones is one solution but provides only a partial solution to the problem. Microphone gain calibration provides only an overall gain calibration instead of a frequency response calibration. Moreover, even if calibrated at the factory, microphone response may drift over time.

Thus, it remains a requirement in the art to provide a way for calibrating a dual-microphone system when in use in the field, which provides a frequency response calibration in real-time.

SUMMARY OF THE INVENTION

A cellular telephone or other system with dual microphones self-calibrates itself on-the-fly. The system selects one of the microphones as a reference and calibrates the frequency response of the two microphones using the first microphone as a reference so that they have a matched frequency amplitude response.

To achieve this on-the-fly calibration, the system uses background noise for calibration purposes. While ambient (background) noise changes all the time, it usually falls back to the noise floor or "minima" at some time. The system tracks the slowly-changing ambient noise "minima" and uses this "minima" as a calibration signal. The signal power spectra of the noise minima at the two microphones are used to calibrate the respective microphone frequency response.

This technique is based on two assumptions. First, it assumes that the ambient noise is a diffused noise field, that is, not from a single point source or the like. Alternatively, the noise is from far field (a distance away from the microphone) so as to behave like a diffused noise field. With one or both assumptions, the noise power spectral density (PSD) from each microphone rshould be very close to one another if frequency amplitude responses of the two microphones are matched. The system may then adapt the frequency amplitude responses of the two microphones so that the PSD from each microphone matches the other, and the system is then calibrated. This calibration could occur any time the device is receiving noise and could be done continuously as the device is being used.

Noise minima is usually stationary or pseudo-stationary, or much more stationary than speech. The noise minima is proportionate to the noise power, as set forth, for example, in I. Cohen and B. Berdugo, *Noise Estimation by Minima Controlled Recursive Averaging for Robust Speech Enhancement*, IEEE Signal Processing Letters, Vol. 9, No. 1, January 2002, pp 12-15, incorporated herein by reference. Thus, the difference of the noise minima of the microphone signals yields the difference of the microphone gain.

DETAILED DESCRIPTION OF THE INVENTION

Figure 1:
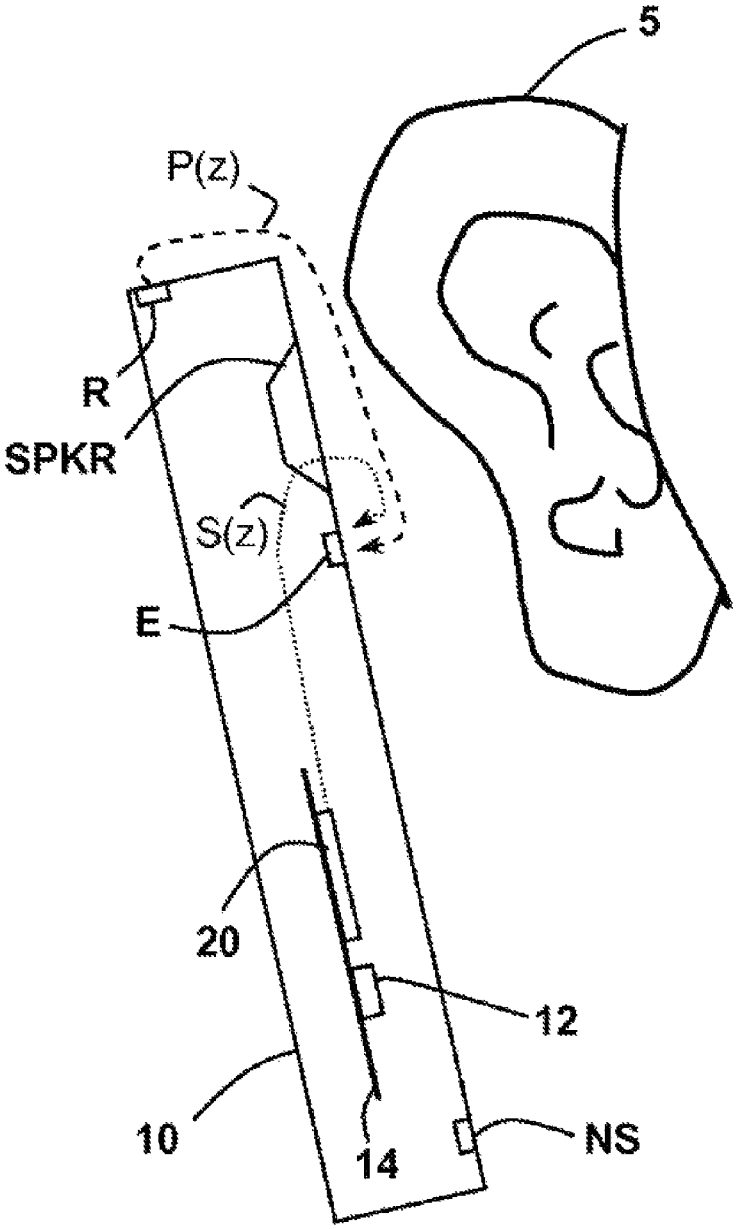
FIG. 1 is a diagram illustrating how dual microphones may be used in a noise cancellation circuit in a cellular telephone.

Dual-microphone frequency amplitude response self-calibration is disclosed in the context of a two-microphone system, for example, using a near speech (NS) microphone for receiving a voice signal and a reference microphone (R) for measuring ambient noise for the noise cancellation circuit. However, dual-microphone frequency amplitude response self-calibration may be applied to other systems as well, including the three-microphone system disclosed in FIG. 1. In such a system, two microphones maybe calibrated relative to the third microphone, and two corrective gain adjustments made relative to that microphone. However for the purposes of the following discussion, only two microphones NS an R are assumed.

Figure 2:
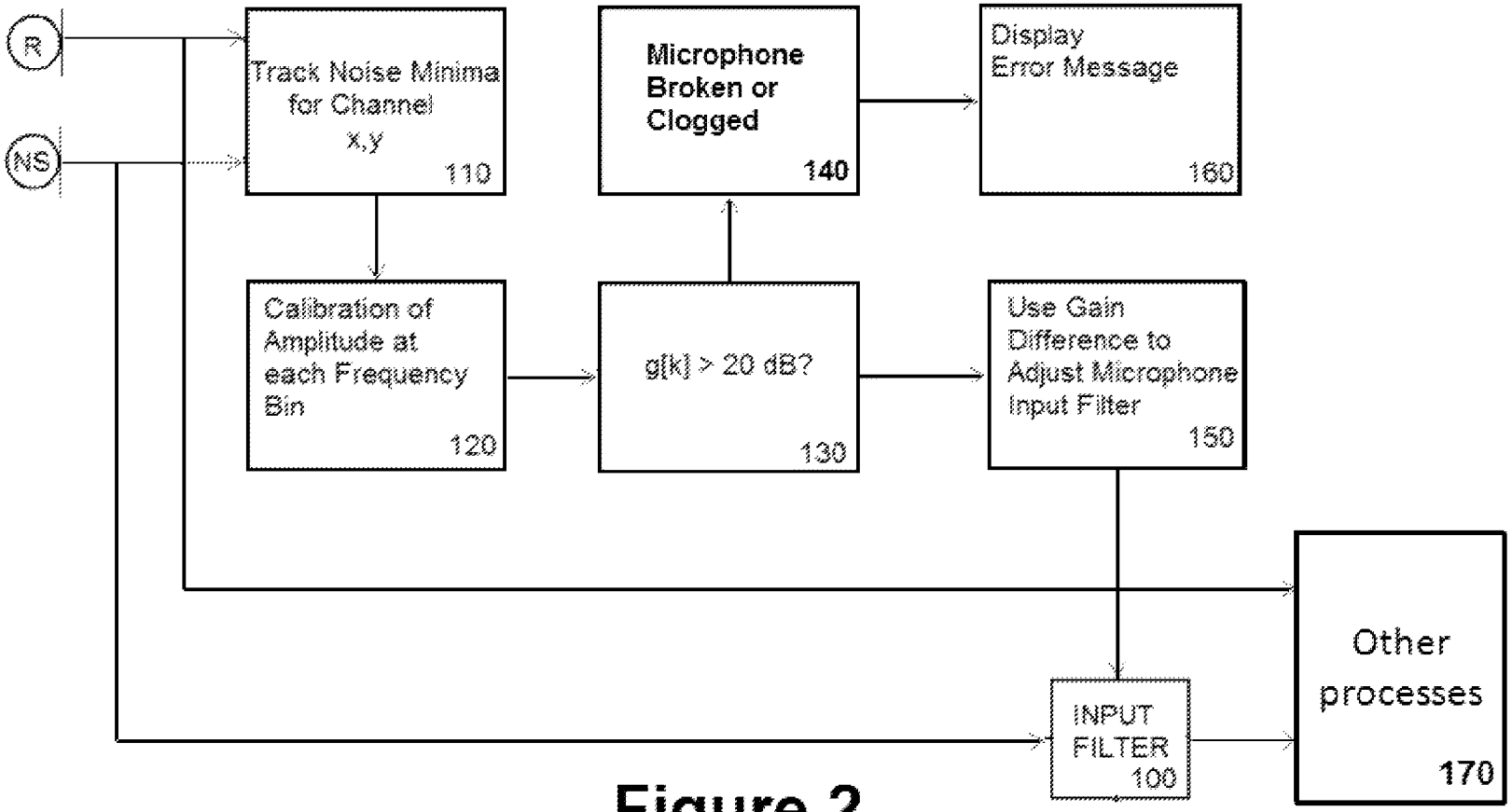
FIG. 2 is a block diagram illustrating dual-microphone frequency amplitude response self-calibration.

Referring to FIG. 2, in block 110 a noise minima tracker tracks noise minima for the calibration of the two microphones. Microphones R and NS, by way of example, may output audio signals in response to ambient noise and the like. The diagram of FIG. 2 has been simplified for the purposes of illustration. The audio signals from microphones R and NS may be suitably digitized in an A/D converter (not shown) to process the signals in the digital domain if desired. An input filter 100 may be provided for one or both microphones R and NS. For the purposes of illustration of the dual-microphone frequency amplitude response self-calibration, only one input filter is illustrated, although in practice, two such filters may be provided. The input filter may adjust the gain of a microphone (e.g., microphone NS in this example) by altering the frequency profile of the microphone signal.

Noise minima may be tracked in the frequency domain as illustrated in block 110. In the routine shown in FIG. 2, minima is tracked for a channel x, where x represents one of the two microphones on a cell phone (in this case, reference microphone R). Minima values for both microphones R and NS are then calculated. This routine may be enabled as a software portion of the microprocessor or may be performed in hardware. For the purposes of testing and illustrating dual-microphone frequency amplitude response self-calibration, it is shown as a software routine. The same routine is then performed for the channel y for near speech microphone NS.

Once the noise minima for both microphones have been tracked in block 110, in block 120, a calibrator calibrates the amplitude of each frequency bin. First, the gain difference between the two microphones R and NS is calculated per frequency bin from the minima of two microphones in step 110. The gain difference g[k] represents a ratio between the minima of the two microphones receiving the same ambient noise signal. The value g[k] is the microphone gain difference per frequency bin and may be calculated as follows:

$$g[k]=\text{alpha}*g[k]+(1-\text{alpha})*x\text{MinEnv}[k]/y\text{MinEnv}[k] \quad (1)$$

where xMinEnv[k] represents the minima level for a particular frequency bin k, for the signal x (e.g., Reference Microphone R) and yMinEnv[k] represents the minima level for a particular frequency bin k, for the signal y (e.g., Near Speech Microphone NS) and alpha represents a smoothing factor that smoothly updates the gain difference.

The order in which the noise minima (x versus y) are calculated is not necessarily important. Similarly, either microphone may be used as the reference microphone relative to the other, by suitably altering the numerator and denominator of equation (1) above.

As illustrated in block 150, from this gain difference, the amplitude and profile of a compensation filter 100 to one or both microphones may be adjusted so that the amplitude and frequency response of the filtered microphone outputs are normalized with regard to one another. The outputs from microphones R and NS are now suitably calibrated relative to one another as the signal levels from both microphones will be equivalent to one another for a given input. These calibrated microphone signals may then be passed to other ambient event detection processes 170 in the cell phone, such as noise cancellation or the like, for use as inputs for those processes. As the microphones are now calibrated relative to one another, the noise cancellation circuit, for example, will operate more effectively, as the relative signal strengths as well as frequency response for each of microphones R and NS will be equivalent for an equivalent audio input.

Block 120 outputs the gain difference per frequency bin g[k], where k represents an individual frequency bin. Frequency gain difference g[k] may be calculated according to equation (1) above, representing a ratio between the minima of the two microphones receiving the same ambient noise signal. As a cellular phone ages, it is possible a microphone may be aging, malfunctioning, broken, or clogged. Thus, in step 130, a determination is made whether the microphone is broken or clogged. If gain g[k] is out of a reasonable range, i.e., greater than 20 dB, then a determination is made that one of the two microphones R, NS is broken or clogged or damaged as determined in microphone condition detector block 140. In block 160, the user may be notified via a message on the device that one of the microphones is broken, clogged, or damaged, and the user may be directed to take the device for servicing. The device may also try to compensate for this error by shutting off or attenuating the noise cancellation circuit or taking other reparative action.

The calibration system, while disclosed in the context of noise cancellation, may be used for a number of applications, for example, in a cellular telephone, where multiple microphones are used to detect what are known as ambient events. These ambient events may include wind noise, scratch, howling, and close talk, as discussed above, or any scenario where signals from dual microphones need to be closely compared.

Equation (1) may be implemented in software as illustrated in Table I below. First, a value xMinEnv[k] (which will be g[k], eventually) is set to the minima of a previous value xTempEnv[k] or a power spectral density value for the frequency bin k. If the detector status is not equal to "OTHERS" (meaning there are no other ambient noise events detected) the value xTempEnv[k] is then calculated using Equation (1) above. If there are any ambient event detection results (from a plurality of such detectors in the system, not shown) other than "OTHERS", which means there are no special events, alpha_min is used to update the Temp Envelope; otherwise, alpha_min_disturb is used to update it. This is different from the aforementioned paper by Cohen and Berdugo, in which they use a single smoothing factor because there are no other detectors involved.

The program then updates xMinEnv[k] to be the minima of itself or the PSD, and xTempEnv[k] likewise. The process is repeated for each frequency bin k within a desired range (e.g., frequency response range of the cellular telephone device, or a selected sub-range thereof).

TABLE I

```
Minima update algorithm:
For each frequency bin:
  For every N frames
    Update xMinEnv[k] = min(xTempEnv[k], xBlockPow[k]);
    Update xTempEnv[k] = alpha*xTempEnv[k] + (1-alpha)*
xBlockPow[k]
      If other detectors (if available in the system) says
there's no disturbance, using smoothing factor alpha =
alpha_min,
if there is disturbance, using alpha = alpha_min_disturb
      If there's no other detectors in the system, using
alpha = alpha_min
  For the frames within the N frames
    Update xMinEnv[k] = min(xMinEnv[k], xBlockPow[k]);
    Update xTempEnv[k] = min(xTempEnv[k], xBlockPow[k]);
Where:
  k denotes the k-th frequency bin.
  xBlockPow [k] denotes the block power for the k-th bin at
channel x
  xMinEnv[k] denotes the minima for the k-th bin at channel x
  xTempEnv[k] denotes the temporary minima for the k-th
  bin at channel x
  alpha_min_disturb is larger than alpha_min, which
  means when disturbance occurs, update the temporary
  minima slower.
```

Figure 3:
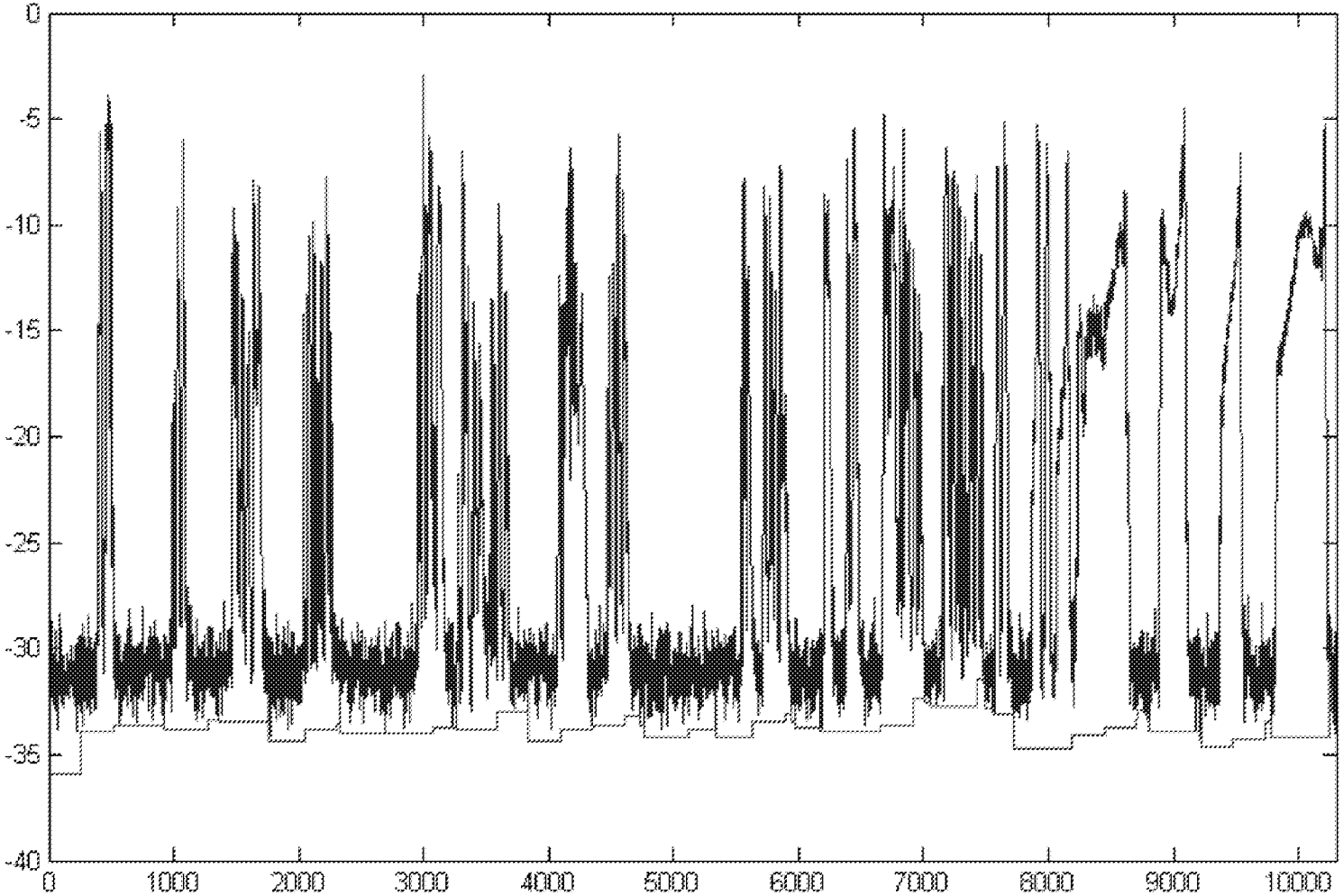
FIG. 3 is a graph illustrating a sample of ambient noise signals, along with corresponding noise minima calculation.

FIG. 3 is a graph illustrating a sample of ambient noise signals from microphones R and NS, along with a noise minima calculation. The Y-axis of the graph represents Sound Pressure Level (SPL) for one frequency bin in decibels (dB) and the X-axis of the graph represents time in seconds. The solid thin line represents a raw ambient signal for the NS microphone, and the dark solid line below it represents the minima calculated for the NS microphone. The dashed thin line represents a raw ambient signal for the R microphone, and the dark dashed line below it represents the minima calculated for the R microphone. The difference in minima between the two microphones is illustrated in FIG. 3.

In the dual-microphone frequency amplitude response self-calibration system and method, noise minima is calculated for each frequency bin at each microphone. From these noise minima calculations, a frequency gain difference g[k] may be calculated according to equation (1) above, representing a ratio between the minima of the two microphones receiving the same ambient noise signal. This ratio may then be used to correct the frequency response of one microphone relative to the other, so that for a given equivalent input, both microphones output the same or similar signal.

While disclosed in terms of calibrating by frequency bin, the dual-microphone frequency amplitude response self-calibration system and method may also be used to self-calibrate microphones by altering the wideband gain of one or more microphones. The frequency response of each microphone may be calculated in a similar manner as illustrated above in connection with FIG. 2, but the calibration factor for input filter 100 may be made by altering the wideband gain of the microphone rather than on a frequency bin basis.

Various noise cancellation systems rely on the accuracy of the microphone signals in order to create an effective noise cancellation signal, which is subtracted from the speech signal. By providing this on-the-fly calibration, the dual-microphone frequency amplitude response self-calibration system and method provide improved noise cancellation, as the error signal is measured more accurately. In addition, the dual-microphone frequency amplitude response self-calibration system and method can also detect the presence of a damaged, broken, or clogged microphone, and can alert the user of this problem and/or disable or modify operation of the noise cancellation system to compensate for this problem.

While disclosed in the context of a cellular telephone with an adaptive noise cancellation system, the present invention may be applied to other types of noise cancellation systems as well as other systems using multiple microphones. For example, the dual-microphone frequency amplitude response self-calibration system and method may be applied to noise cancellation headsets for use in aviation and other applications such as dual microphone noise suppression, microphone array, beamforming and the like. The dual-microphone frequency amplitude response self-calibration system and method may also be used for stereo microphones and other multiple microphone setups, where microphones may require calibration with respect to one another.

While the preferred embodiment and various alternative embodiments of the invention have been disclosed and described in detail herein, it may be apparent to those skilled in the art that various changes in form and detail may be made therein without departing from the spirit and scope thereof.

We claim:

1. In a multiple microphone system having at least two microphones, a method of self-calibration, comprising:

receiving ambient noise signals from the at least two microphones;

tracking noise minima in a time domain for each of the ambient noise signals from the at least two microphones by tracking the noise minima of each of the ambient noise signals from the at least two microphones for a predetermined number of frequency bins;

calculating an amplitude calibration value based on a ratio of the noise minima of each of the ambient noise signals from two of the at least two microphones by calculating the amplitude calibration value for each of the predetermined number of frequency bins based on the ratio of the noise minima of each of the ambient noise signals from the two of the at least two microphones; and altering gain of at least one of the at least two microphones to calibrate one of the at least two microphones relative to another of the at least two microphones based on the amplitude calibration value.

2. The method of claim 1, further comprising:

comparing the amplitude calibration value based on the ratio of the noise minima of each of the ambient noise signals from the two of the at least two microphones with a predetermined value, if the amplitude calibration value based on the ratio of the noise minima of each of the ambient noise signals from the two of the at least two microphones is greater than the predetermined value, determining that one or more of the at least two microphones is broken, malfunctioning, or clogged, and notifying a user that one or more of the at least two microphones is broken, malfunctioning, or clogged.

3. The method of claim 1, wherein calculating the amplitude calibration value for each frequency bin further comprises smoothing amplitude calibration value changes over time by multiplying the amplitude calibration value by a predetermined smoothing factor.

4. The method of claim 3, wherein calculating the amplitude calibration value for each frequency bin based on the ratio of the noise minima of each of the ambient noise signals from the two of the at least two microphones further comprises calculating a value g[k] as follows:

$$g[k]=\text{alpha}*g[k]+(1-\text{alpha})*x\text{MinEnv}[k]/y\text{MinEnv}[k]$$

where xMinEnv[k] represents a minima level for a particular frequency bin k for a signal x from one of the at least two microphones and yMinEnv[k] represents a minima level for a particular frequency bin k for the signal y from another of the at least two microphones and alpha represents the predetermined smoothing factor.

5. A self-calibrating multiple microphone system, comprising at least two microphones, comprising:

the at least two microphones each receiving at least ambient noise signals;

a noise minima tracker receiving the ambient noise signals from each of the at least two microphones and tracking noise minima in a time domain for each of the ambient noise signals from the at least two microphones by tracking the noise minima of each of the ambient noise signals from the at least two microphones for a predetermined number of frequency bins;

a calibrator calculating an amplitude calibration value based on a ratio of the noise minima of each of the ambient noise signals from two of the at least two microphones by calculating the amplitude calibration value for each of the predetermined number of frequency bins based on the ratio of the noise minima of each of the ambient noise signals from the two of the at least two microphones; and an input filter coupled to at least one of the at least two microphones having a gain profile altered by the calculated amplitude calibration value to calibrate one of the at least two microphones relative to another of the at least two microphones.

6. The system of claim 5, further comprising:

a microphone condition detector comparing the amplitude calibration value based on the ratio of the noise minima of each of the ambient noise signals from the two of the at least two microphones with a predetermined value, and if the amplitude calibration value based on the ratio of the noise minima of each of the ambient noise signals from the two of the at least two microphones is greater than the predetermined value, determining that one or more of the at least two microphones is malfunctioning, broken, or clogged, and notifying a user that one or more of the at least two microphones is malfunctioning, broken, or clogged.

7. The system of claim 5, wherein calculating the amplitude calibration value for each frequency bin further includes smoothing amplitude calibration value changes over time by multiplying the amplitude calibration value by a predetrmined smoothing factor.

8. The system of claim 7, wherein the calibrator calculates the amplitude calibration value for each frequency bin based on the ratio of the noise minima of each of the ambient noise signals from the two of the at least two microphones as g[k] as follows:

$$g[k]=\text{alpha}*g[k]+(1-\text{alpha})*x\text{MinEnv}[k]/y\text{MinEnv}[k]$$

where xMinEnv[k] represents a minima level for a particular frequency bin k for a signal x from one of the at least two microphones and yMinEnv[k] represents a minima level for a particular frequency bin k for the signal y from another of the at least two microphones and alpha represents the predetermined smoothing factor.

9. A self-calibrating cellular telephone including at least two microphones, comprising:

the at least two microphones on the self-calibrating cellular telephone each receiving at least ambient noise signals;

a noise minima tracker receiving the ambient noise signals from each of the at least two microphones and tracking noise minima in a time domain for each of the ambient noise signals from the at least two microphones by tracking the noise minima of each of the ambient noise signals from the at least two microphones for a predetermined number of frequency bins;

a calibrator calculating an amplitude calibration value based on a ratio of the noise minima of each of the ambient noise signals from two of the at least two microphones by calculating the amplitude calibration value for each of the predetermined number of frequency bins based on the ratio of the noise minima of each of the ambient noise signals from the two of the at least two microphones; and an input filter coupled to at least one of the at least two microphones having a gain profile altered by the calculated amplitude calibration value to calibrate one of the at least two microphones relative to another of the at least two microphones.

10. The self-calibrating cellular telephone of claim 9, further comprising:

a microphone condition detector comparing the amplitude calibration value based on the ratio of the noise minima of each of the ambient noise signals from the two of the at least two microphones with a predetermined value, and if the amplitude calibration value based on the ratio of the noise minima of each of the ambient noise signals from the two of the at least two microphones is greater than the predetermined value, determining that one or more of the at least two microphones is malfunctioning, broken, or clogged, and notifying a user that one or more of the at least two microphones is malfunctioning, broken, or clogged.

11. The self-calibrating cellular telephone of claim 9, wherein calculating the amplitude calibration value for each frequency bin further includes smoothing amplitude calibration value changes over time by multiplying the amplitude calibration value by a predetermined smoothing factor.

12. A self-calibrating cellular telephone including at least two microphones, comprising:

the at least two microphones on the self-calibrating cellular telephone each receiving audio signals including ambient noise signals;

a noise minima tracker receiving the ambient noise signals from the at least two microphones and tracking noise minima for each of the ambient noise signals from the at least two microphones;

a calibrator calculating an amplitude calibration value based on a ratio of the noise minima of each of the ambient noise signals from two of the at least two microphones; and an input filter coupled to at least one of the at least two microphones having a gain profile altered by the calculated amplitude calibration value to calibrate one of the at least two microphones relative to another of the at least two microphones, wherein the noise minima tracker tracks the noise minima of each of the ambient noise signals from the at least two microphones for a predetermined number of frequency bins, wherein the calibrator calculates the amplitude calibration value for each frequency bin based on the ratio of the noise minima of each of the ambient noise signals from the two of the at least two microphones, wherein calculating the amplitude calibration value for each frequency bin further includes smoothing amplitude calibration value changes over time by multiplying the amplitude calibration value by a predetermined smoothing factor, and wherein the calibrator calculates the amplitude calibration value for each frequency bin based on the ratio of the noise minima of each of the ambient noise signals from the two of the at least two microphones as g[k] as follows:

$$g[k]=\text{alpha}*g[k]+(1-\text{alpha})*x\text{MinEnv}[k]/y\text{MinEnv}[k]$$

where xMinEnv[k] represents a minima level for a particular frequency bin k for a signal x from one of the at least two microphones and yMinEnv[k] represents a minima level for a particular frequency bin k for the signal y from another of the at least two microphones and alpha represents the predetermined smoothing factor.

13. A self-calibrating cellular telephone including at least two microphones, comprising:

the at least two microphones on the self-calibrating cellular telephone each receiving audio signals including ambient noise signals;

a noise minima tracker receiving the ambient noise signals from the at least two microphones and tracking noise minima for each of the ambient noise signals from the at least two microphones;

a calibrator calculating an amplitude calibration value based on a ratio of the noise minima of each of the ambient noise signals from two of the at least two microphones; and an input filter coupled to at least one of the at least two microphones having a gain profile altered by the calculated amplitude calibration value to calibrate one of the at least two microphones relative to another of the at least two microphones, wherein the noise minima tracker tracks the noise minima of each of the ambient noise signals from the at least two microphones for a predetermined number of frequency bins, wherein the calibrator calculates the amplitude calibration value for each frequency bin based on the ratio of the noise minima of each of the ambient noise signals from the two of the at least two microphones as g[k] as follows:

$$g[k]=\text{alpha}*g[k]+(1-\text{alpha})*x\text{MinEnv}[k]/y\text{MinEnv}[k]$$

where xMinEnv[k] represents a minima level for a particular frequency bin k for a signal x from one of the at least two microphones and yMinEnv[k] represents a minima level for a particular frequency bin k for the signal y from another of the at least two microphones and alpha represents a predetermined smoothing factor.

* * * * *